US010784605B2

(12) United States Patent
Tsuji et al.

(10) Patent No.: US 10,784,605 B2
(45) Date of Patent: Sep. 22, 2020

(54) CONNECTOR WITH A CONTACT RETAINED IN A HOUSING

(71) Applicant: Tyco Electronics Japan G.K., Kanagawa (JP)

(72) Inventors: Junya Tsuji, Kanagawa (JP); Katsuhiko Kobayashi, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 16/210,733

(22) Filed: Dec. 5, 2018

(65) Prior Publication Data

US 2019/0173212 A1 Jun. 6, 2019

(30) Foreign Application Priority Data

Dec. 5, 2017 (JP) ..... 2017-233161
Oct. 1, 2018 (JP) ..... 2018-186546

(51) Int. Cl.

| | |
|---|---|
| ***H01R 24/00*** | (2011.01) |
| ***H01R 12/72*** | (2011.01) |
| ***H01R 13/24*** | (2006.01) |
| ***H01R 13/502*** | (2006.01) |
| ***H01R 13/6597*** | (2011.01) |
| ***H01R 13/6582*** | (2011.01) |

(Continued)

(52) U.S. Cl.

CPC ..... *H01R 12/722* (2013.01); *H01R 12/725* (2013.01); *H01R 13/24* (2013.01); *H01R 13/405* (2013.01); *H01R 13/41* (2013.01); *H01R 13/502* (2013.01); *H01R 13/504* (2013.01); *H01R 13/6473* (2013.01); *H01R 13/6582* (2013.01); *H01R 13/6597* (2013.01); *H01R 13/2442* (2013.01)

(58) Field of Classification Search

CPC .... H01R 12/73; H01R 12/732; Y10S 493/951
USPC ..... 439/631, 634, 637
See application file for complete search history.

(56) References Cited

U.S. PATENT DOCUMENTS 3,243,761 A * 3/1966 Heinz ..... H01R 12/7005 439/634
3,482,201 A * 12/1969 Schneck ..... H01R 31/00 439/497

(Continued)

FOREIGN PATENT DOCUMENTS

EP 3093925 A1 11/2016
JP 2005-19305 A 1/2005

(Continued)

*Primary Examiner* — Phuong K Dinh
(74) *Attorney, Agent, or Firm* — Barley Snyder

(57) ABSTRACT

A connector comprises a housing and a plurality of contacts retained in the housing. Each of the contacts extends in a longitudinal direction and has a retained portion, a contacting portion disposed in front of the retained portion in the longitudinal direction, and a connecting portion disposed behind the retained portion in the longitudinal direction. Each of the contacting portion and the connecting portion are shifted with respect to the retained portion in a vertical direction perpendicular to the longitudinal direction. The housing is in contact with the retained portion of each of the contacts from both above and below in the vertical direction and from both right and left in a lateral direction perpendicular to the vertical direction and the longitudinal direction.

9 Claims, 12 Drawing Sheets

(51) Int. Cl.

| | |
|---|---|
| ***H01R 13/405*** | (2006.01) |
| ***H01R 13/504*** | (2006.01) |
| ***H01R 13/41*** | (2006.01) |
| ***H01R 13/6473*** | (2011.01) |

(56) References Cited

U.S. PATENT DOCUMENTS

| | | | | | |
|---|---|---|---|---|---|
| 3,702,456 | A * | 11/1972 | Patton | H01R 4/2462 | 439/404 |
| 5,041,023 | A * | 8/1991 | Lytle | H01R 12/721 | 439/637 |
| 7,004,767 | B2 | 2/2006 | Kim | | |
| 7,204,719 | B2 * | 4/2007 | Kikuchi | H01R 13/113 | 439/631 |
| 9,735,486 | B1 * | 8/2017 | Yu | H01R 12/707 | |

FOREIGN PATENT DOCUMENTS

| | | | |
|---|---|---|---|
| JP | 2005-52204 | A | 7/2005 |
| JP | 2005-522004 | A | 7/2005 |
| JP | 2016-219101 | A | 12/2016 |

* cited by examiner

CONNECTOR WITH A CONTACT RETAINED IN A HOUSING

CROSS-REFERENCE TO RELATED APPLICATIONS

This application claims the benefit of the filing date under 35 U.S.C. § 119(a)-(d) of Japanese Patent Application No. 2018-186546, filed on Oct. 1, 2018, and Japanese Patent Application No. 2017-233161, filed on Dec. 5, 2017.

FIELD OF THE INVENTION

The present invention relates to a connector and, more particularly, to a connector having a housing and a plurality of electrically conductive contacts retained in the housing.

BACKGROUND

Signal processing speeds of electronic circuits are ever-increasing and, accordingly, an electrical connector is required to transmit signals of increasingly higher speed. Japanese Patent Application No. 2016-219101A discloses a connector having a structure in which contacts are inserted into passageways of a housing. A contact portion curved vertically is provided at a distal end of each contact extending through the passageway of the housing. The passageway of the housing is wider than a plate thickness of the contact and sufficiently dimensioned vertically to allow passage of the contact portion. In addition, serrations for press-fitting the contact into the passageway and retaining the contact in the passageway are formed at right and left sides of the contact.

In the connector disclosed in JP 2016-219101A, a vertical dimension of the passageway is wider than the plate thickness of the contact. Therefore, one of upper and lower faces of the contact is separated from the housing and, as compared with a case where both the upper and lower faces of the contact are in contact with the housing, the impedance of the contact tends to increase partially to cause an impedance mismatch. Additionally, a region of the contact having the serrations is wider than other portions of the contact, also contributing to the impedance mismatch. The impedance mismatch is disadvantageous for high-speed signal transmission.

SUMMARY

A connector comprises a housing and a plurality of contacts retained in the housing. Each of the contacts extends in a longitudinal direction and has a retained portion, a contacting portion disposed in front of the retained portion in the longitudinal direction, and a connecting portion disposed behind the retained portion in the longitudinal direction. Each of the contacting portion and the connecting portion are shifted with respect to the retained portion in a vertical direction perpendicular to the longitudinal direction. The housing is in contact with the retained portion of each of the contacts from both above and below in the vertical direction and from both right and left in a lateral direction perpendicular to the vertical direction and the longitudinal direction.

BRIEF DESCRIPTION OF THE DRAWINGS

The invention will now be described by way of example with reference to the accompanying Figures, of which.

DETAILED DESCRIPTION OF THE EMBODIMENTS

Figure 1A:
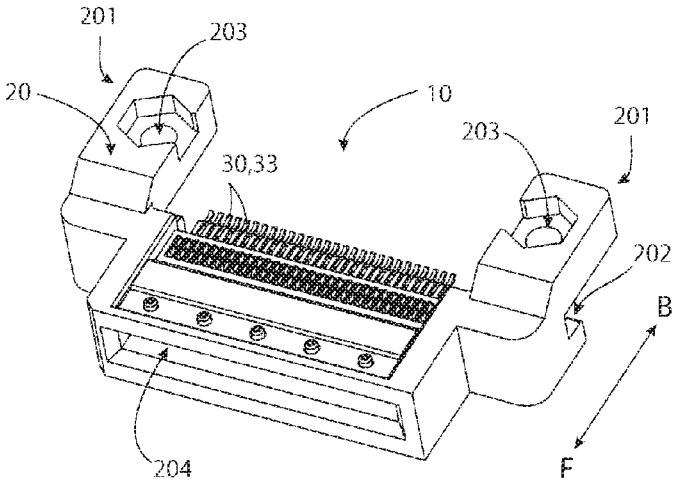
FIG. 1A is a front perspective view of a connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector 10 according to an embodiment is shown in FIGS. 1A-5B. The connector 10, as shown in FIGS. 1A and 1B, includes a housing 20 and a plurality of contacts 30. The housing 20 is formed from a dielectric material and the contact 30 is electrically conductive.

Figure 1B:
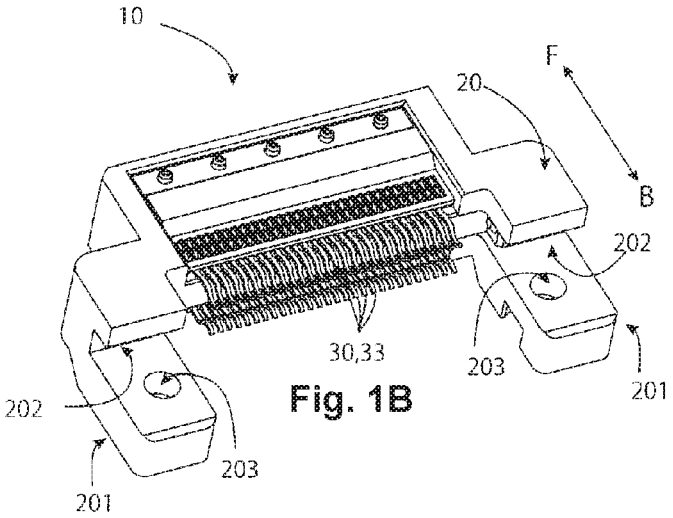
FIG. 1B is a rear perspective view of the connector of FIG. 1A.

As shown in FIGS. 1A and 1B, the housing 20 has attachment portions 201 for connecting the housing 20 to one end edge of a first circuit board. The attachment portions 201 are provided on both lateral sides of the contacts 30 within the housing 20. The attachment portion 201 has an attachment recess 202, and the end edge of the first circuit board is inserted into the attachment recess 202. A metallic part for attachment is inserted into an attachment hole 203 of the attachment portion 201 to attach the connector 10 to the circuit board. Connection pads arranged with the same pitch as the arrangement pitch of the contacts 30 are formed on the end edge of the circuit board which is inserted into the attachment recess 202. After the connector 10 is attached to the first circuit board, the contact 30 and the connection pad on the circuit board corresponding to each other are connected together by soldering.

A mating opening 204 is formed in the housing 20 of the connector 10, as shown in FIG. 1A. A distal end of a second circuit board different from the first circuit board to which the connector 10 has been attached is inserted into the mating opening 204. The contact 30 and connection pads on the distal end of the second circuit board corresponding to each other are electrically connected. The first circuit board having the connector 10 attached thereto and the second circuit board having the distal end inserted in the connector 10 are electrically connected together by the contacts 30. In FIGS. 1A and 1B, a side of the connector 10 at which the mating opening 204 is located is defined as a front F, and a side of the connector 10 at which the attachment portions 201 are located is defined as a back B.

The connector 10 is mirror symmetric with respect to a horizontal plane across a center between top and bottom. Only the upper half structure will be described below. Accordingly, in FIG. 2, only the upper half is shown in a disassembled state, and the lower half is shown in an assembled state.

Figure 2:
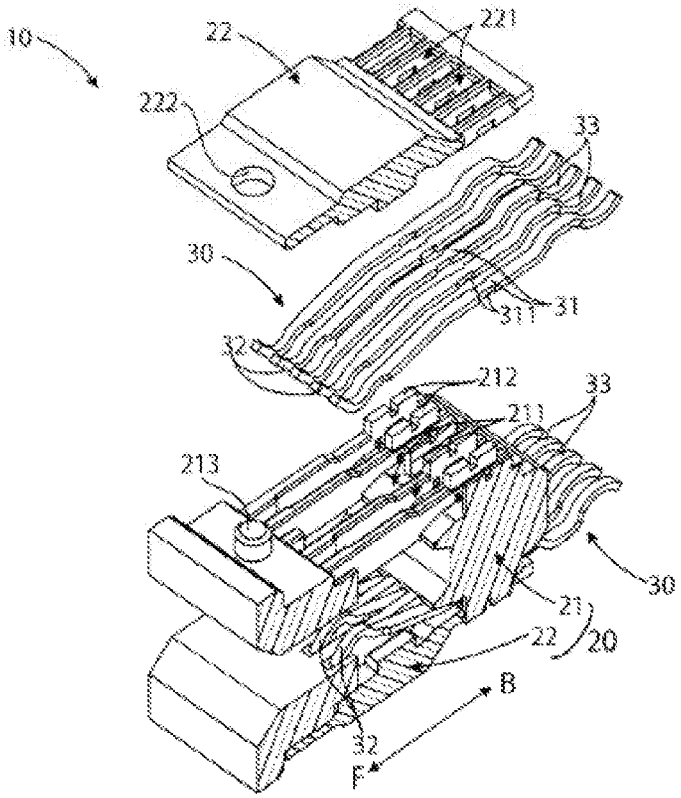
FIG. 2 is a sectional perspective view of the connector of FIG. 1A.

As shown in FIG. 2, the housing 20 has a base portion 21 and a pair of lid portions 22. The base portion 21 is positioned in a region between the upper and lower two rows of contacts 30. The pair of lid portions 22 hold the upper and lower rows of contacts 30 to the base portion 21 from above and below. The upper row of contacts 30 is held from above and below between the base portion 21 and the upper lid portion 22. The lower row of contacts 30 is held from above and below between the base portion 21 and the lower lid portion 22.

As shown in FIG. 2, the contact 30 has a shape extending in a longitudinal direction. The contact 30 has a retained portion 31 in a central section and has a contacting portion 32 and a connecting portion 33 in front of and behind the retained portion 31, respectively, in the longitudinal direction. The retained portion 31 is a portion which is retained by the housing 20. Each of the contacting portion 32 and the connecting portion 33 has a portion shifted in a vertical direction with respect to the retained portion 31, the vertical direction is perpendicular to the longitudinal direction. A notched portion 311 for positioning the contact 30 with respect to the housing 20 is provided in the retained portion 31 of the contact 30. The notched portion 311, however, does not impair maintaining the adverse effect of an impedance mismatch to a high-speed signal transmitted by the contact 30 within an acceptable range.

A plurality of contact positioning grooves 211 are formed in the base portion 21 of the housing 20, as shown in FIG. 2, and a plurality of protruding portions 212 are formed between the contact positioning grooves 211. A boss 213 for attaching the lid portion 22 is provided on the base portion 21. A plurality of opening portions 221 which each protruding portion 212 enters and a hole 222 which the boss 213 enters are formed in the lid portion 22.

Figure 3:
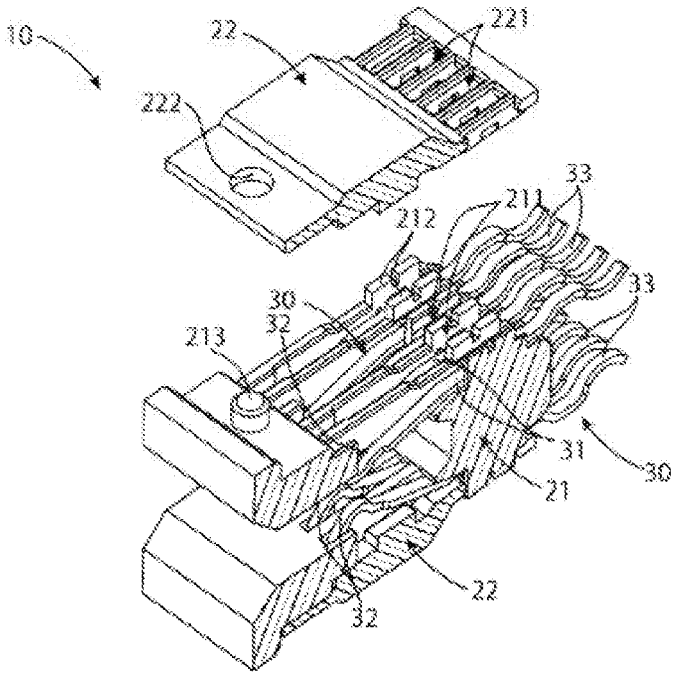
FIG. 3 is a sectional perspective view of the connector of FIG. 1A.
Figure 4:
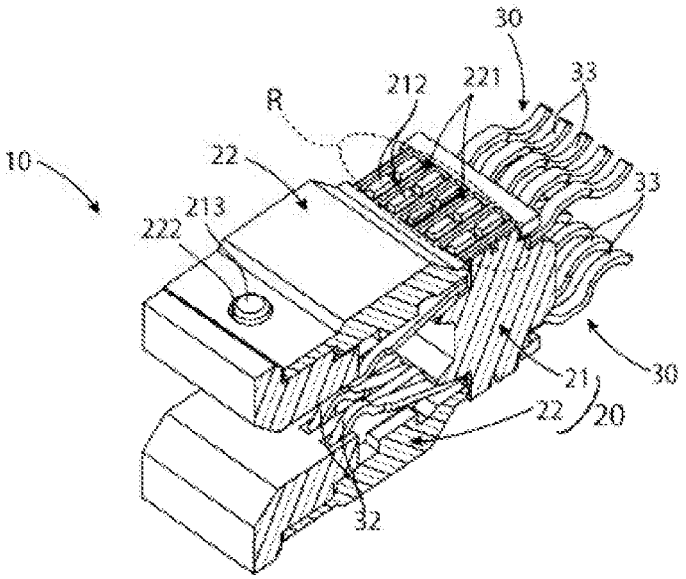
FIG. 4 is a sectional perspective view of the connector of FIG. 1A.

The contacts 30 are positioned in the contact positioning grooves 211 of the base portion 21, as shown in FIG. 3. As shown in FIG. 4, the lid portion 22 is placed on the base portion 21. When the lid portion 22 is placed thereon, the boss 213 of the base portion 21 enters the hole 222 of the lid portion 22. Simultaneously, each of the plurality of protruding portions 212 provided in the base portion 21 enters each of the plurality of opening portions 221 of the lid portion 22.

After the lid portion 22 is placed on the base portion 21, as shown in FIG. 4, the boss 213 of the base portion 21 and a region within an ellipse R shown in FIG. 4 are heat-staked. Thereupon, the boss 213 and the protruding portions 212 of the base portion 21 are staked to the hole 222 and the opening portions 221 of the lid portion 22. In other embodiment, other methods of staking such as ultrasonic staking may be performed. Alternatively, the base portion 21 and the lid portion 22 may be welded together by using ultrasound or a laser.

Figure 5A:
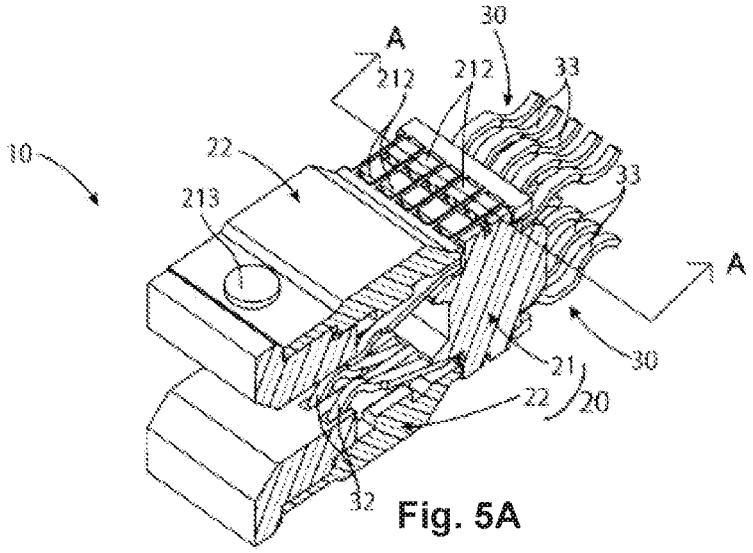
FIG. 5A is a sectional perspective view of the connector of FIG. 1A in a fully assembled state.
Figure 5B:
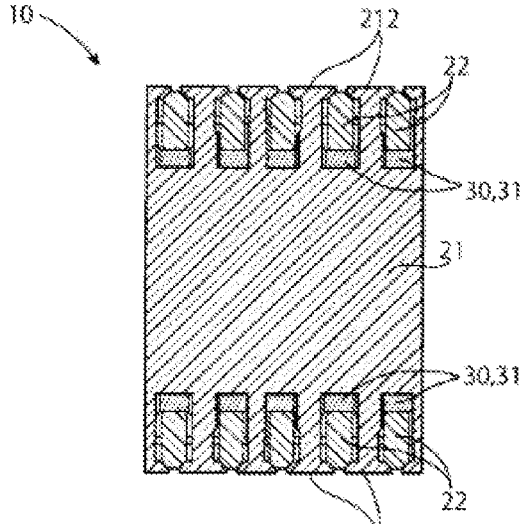
FIG. 5B is a sectional front view of the connector in the fully assembled state taken along arrows A-A of FIG. 5A.

As shown in FIGS. 5A and 5B, the housing 20 composed of the base portion 21 and the lid portion 22 comes into contact with the retained portions 31 of the contacts 30 from both above and below in the vertical direction and from both right and left in a lateral direction perpendicular to the vertical direction and the longitudinal direction. The contacts 30 are thus retained in the housing 20. As compared with a connector in which the passageway is wider than the thickness of the contact, the impedance of the contact 30 can be lowered and the connector 10 of the present embodiment is suitable for high-speed signal transmission. Further, it is unnecessary for the contacts 30 to have serrations for press-fitting.

Other embodiments of the connector 10 are described in greater detail below. In each of the below embodiments, like reference numbers refer to like elements, even if the element has a difference in shape or the like, and only the differences from the embodiment described above with reference to FIGS. 1A-5B will be described in greater detail.

Figure 6A:
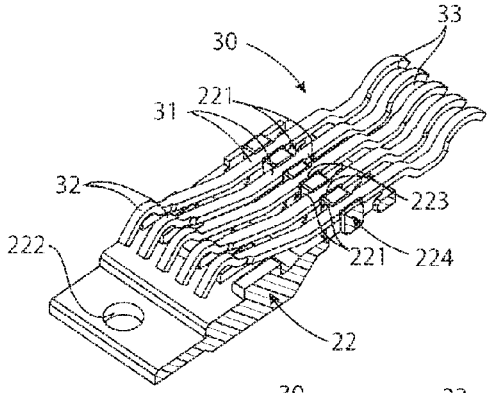
FIG. 6A is a sectional perspective view of a lid portion of a connector according to another embodiment.
Figure 6B:
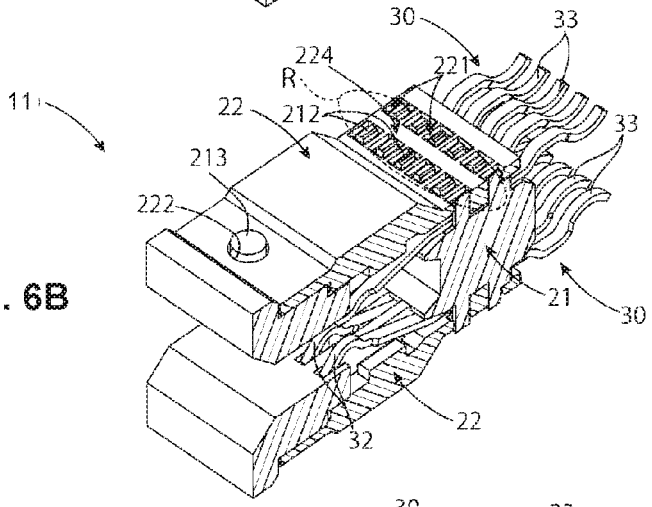
FIG. 6B is a sectional perspective view of the lid portion placed on a base portion of the connector of FIG. 6A.
Figure 6C:
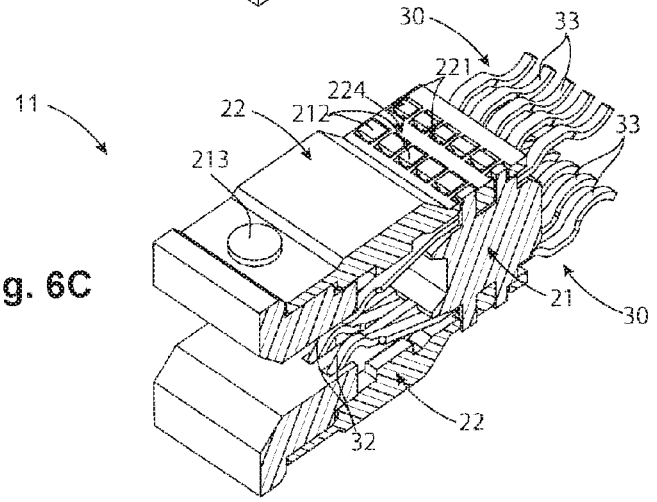
FIG. 6C is a sectional perspective view of the connector of FIG. 6A in a fully assembled state.

A connector 11 according to another embodiment is shown in FIGS. 6A-6C. A contact supporting portion 224 having a contact supporting groove 223 formed therein for supporting the contact 30 is provided inside the lid portion 22 of the connector 11. The opening portions 221 are formed in positions in front of and behind the contact supporting portion 224. The protruding portions 212 which enter the opening portions 221 of the lid portion 22 are so provided in the base portion 21 in positions in front of and behind the contact supporting portions 224 as to correspond to the opening portions 221.

In the connector 10 of FIGS. 1A-5B, the contacts 30 are first placed on the base portion 21, as shown in FIG. 3, and then the lid portion 22 is placed thereon. In contrast, in the connector 11, the contact supporting portion 224 is provided in the lid portion 22, and the contacts 30 are first supported on the lid portion 22, as shown in FIG. 6A. Thereafter, the lid portion 22 supporting the contacts 30 is placed on the base portion 21. As shown in FIG. 6B, the boss 213 of the base portion 21 enters the hole 222 of the lid portion 22. In addition, simultaneously, each of the plurality of protruding portions 212 of the base portion 21 enters each of the plurality of opening portions 221 of the lid portion 22. Thereafter, the boss 213 of the base portion 21 and a region within the ellipse R in FIG. 6B are heat-staked and the boss 213 and the protruding portions 212 of the base portion 21 are staked to the hole 222 and the opening portions 221 of the lid portion 22. In the fully assembled connector 11 shown in FIG. 6C, the housing 20 composed of the base portion 21 and the lid portion 22 comes into contact with the retained portions 31 of the contacts 30 from both above and below and from both right and left to retain the contacts 30 in the housing 20.

Figure 7:
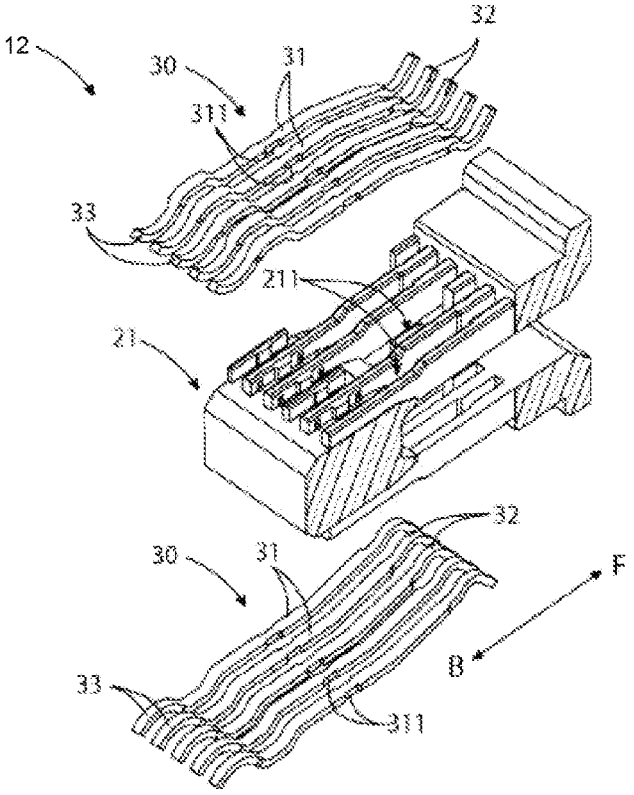
FIG. 7 is an exploded sectional perspective view of a connector according to another embodiment.
Figure 8A:
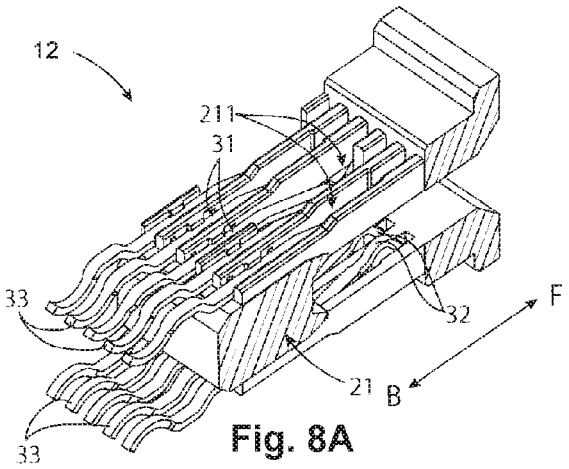
FIG. 8A is a sectional perspective view of the connector of FIG. 7.
Figure 8B:
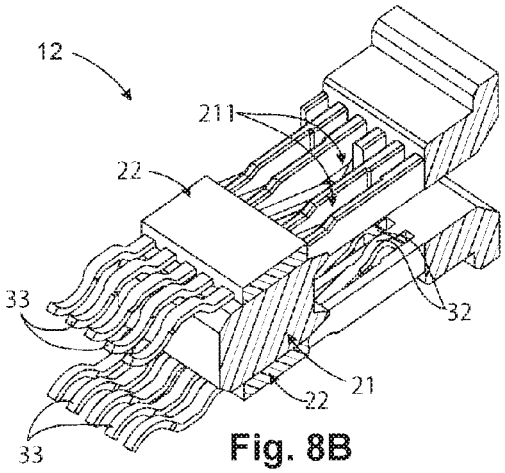
FIG. 8B is a sectional perspective view of the connector of FIG. 7 in a fully assembled state.

A connector 12 according to another embodiment is shown in FIGS. 7, 8A, and 8B. As shown in FIG. 7, the contact positioning grooves 211 are also formed in the base portion 21, like the base portion 21 in the connectors 10, 11. However, the protruding portion 212 or the boss 213 for staking the lid portion 22, which are provided in the base portion 21 in the connectors 10, 11, is not provided in the base portion 21 in the connector 12. In the connector 12, the contacts 30 are positioned in the base portion 21 as shown in FIG. 8A, and the retained portions 31 of the contacts 30 and a region of the base portion 21 having the retained portions 31 positioned therein are covered with the lid portion 22 formed by overmolding, as shown in FIG. 8B. Even when the lid portion 22 is formed by overmolding in this manner, the housing 20 composed of the base portion 21 and the lid portion 22 comes into contact with the retained portions 31 of the contacts 30 from both above and below and from both right and left to retain the contacts 30 in the housing 20.

Figure 9A:
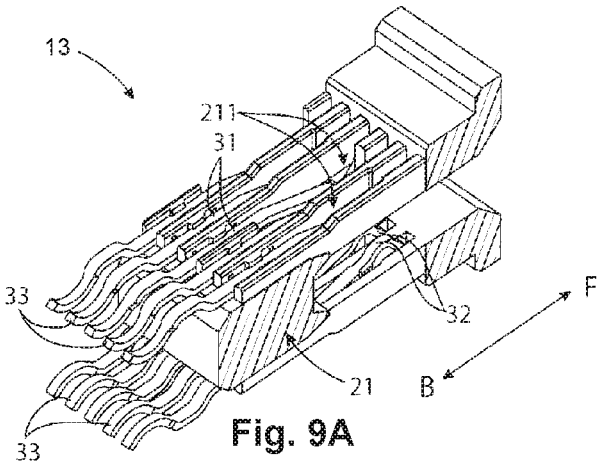
FIG. 9A is a sectional perspective view of a connector according to another embodiment.
Figure 9B:
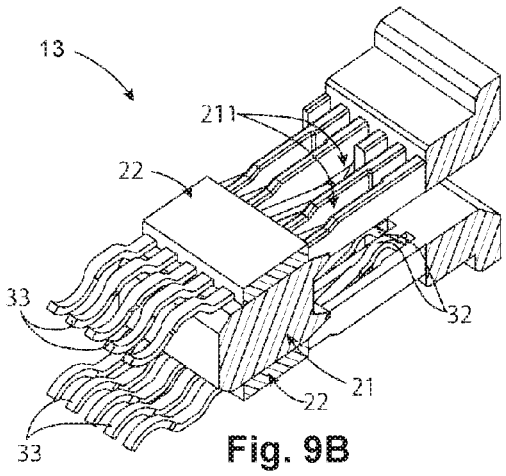
FIG. 9B is a sectional perspective view of the connector of FIG. 9A in a fully assembled state.

A connector 13 according to another embodiment is shown in FIGS. 9A and 9B. In the connector 13, the base portion 21 and the contact 30 are identical to those in the connector 12. In the connector 13, in the base portion 21 having the same shape as in the connector 12, the contact 30 is positioned as shown in FIG. 9A. Thereafter, a dielectric adhesive is applied to the retained portions 31 of the contacts 30 and the region of the base portion 21 having the retained portions 31 positioned therein. Then, as shown in FIG. 9B, the lid portion 22 is formed by a curing of the adhesive in the region where the adhesive has been applied. Even in a case where the lid portion 22 is formed by an adhesive, the housing 20 composed of the base portions 21 and the lid portion 22 comes into contact with the retained portions 31 of the contacts 30 from both above and below and from both right and left to retain the contacts 30 in the housing 20.

Figure 10:
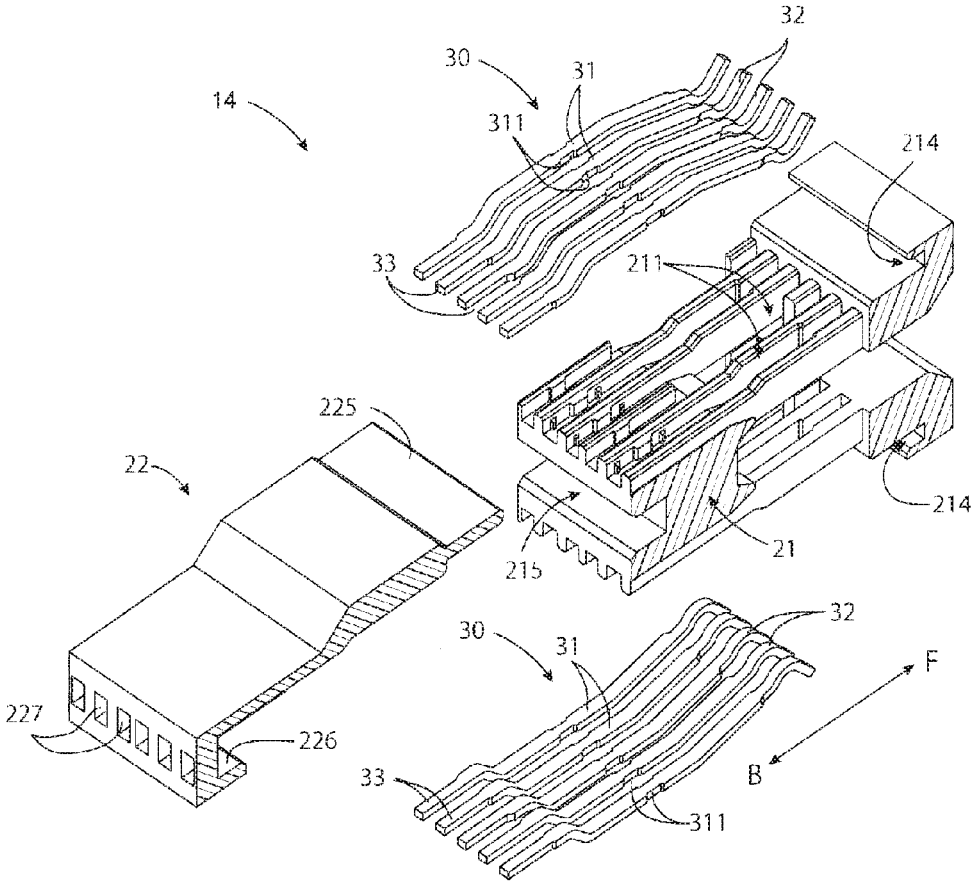
FIG. 10 is an exploded sectional perspective view of a connector according to another embodiment.

A connector 14 according to another embodiment is shown in FIGS. 10-12C. As shown in FIG. 10, the base portion 21 and the lid portion 22 constituting the housing 20 and the upper and lower two rows of contacts 30 are shown; only the upper lid portion 22 is shown, but the upper and lower lid portions 22 are members having the same shape. A lid portion which is identical to the upper lid portion 22 shown in FIG. 10 in an upside-down attitude is used as the lower lid portion.

Figure 11:
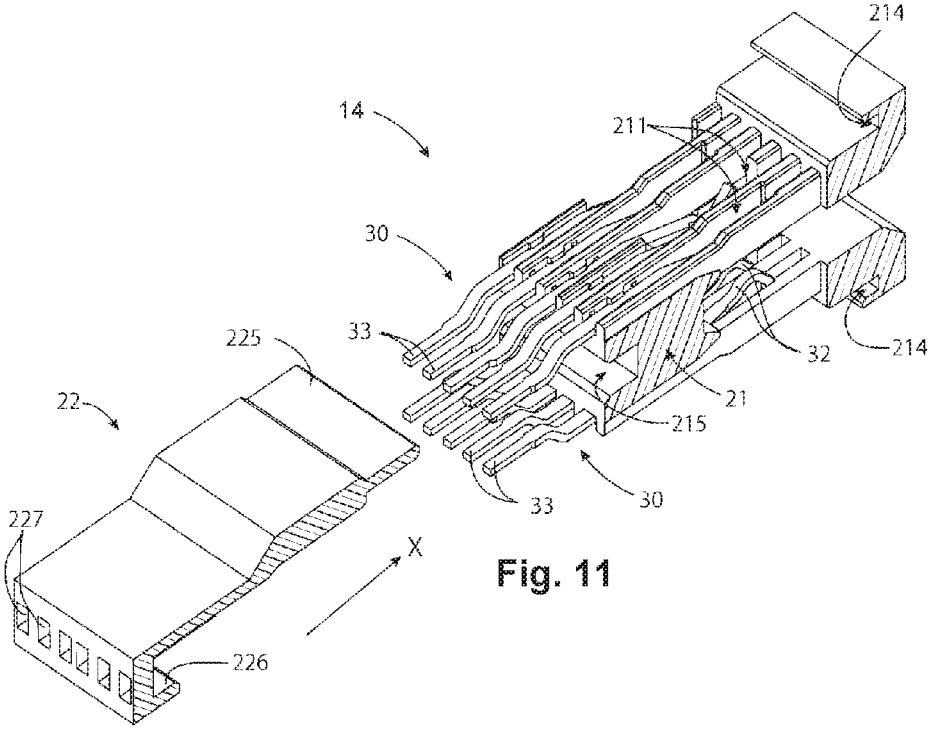
FIG. 11 is a sectional perspective view of the connector of FIG. 10.

In the connector 14, after the contacts 30 are placed on the base portion 21, the lid portion 22 is slid in a direction of an arrow X shown in FIG. 11, and thereby attached to the base portion 21 such that the contacts 30 are held between the lid portion 22 and the base portion 21. A fitting portion 225 for attachment to the base portion 21 is formed at a leading end of the lid portion 22 in the direction of the arrow X shown in FIG. 11. In order to correspond to the fitting portion 255, two fitting grooves 214 corresponding to the upper and lower lid portions 22, respectively, for receiving the fitting portion 225 are formed in the base portion 21. A fitting portion 226 for attachment to the base portion 21 is also formed at a trailing end of the lid portion 22 in the direction of the arrow X.

In order to correspond to the fitting portion 226, a fitting groove 215 for receiving the fitting portion 226 is formed in the base portion 21 of the connector 14, as shown in FIG. 11. The fitting portions 226 of both the upper and lower lid portions 22 enter the fitting groove 215. The lid portion 22 has passageways 227 which the connecting portions 33 of the contacts 30 penetrate when the lid portion 22 is slid in the direction of the arrow X. In order to correspond to the passageway 227, the connecting portion 33 has a different shape from the connecting portion 33 of the contact 30 in the connector 10. In the connector 14, the contacts 30 are placed on the base portion 21, then the lid portion 22 is slid in the direction of the arrow X and the fitting portions 225, 226 of the lid portion 22 are fitted into the fitting grooves 214, 215 of the base portion 21. The lid portion 22 is thereby supported on the base portion 21.

Figure 12A:
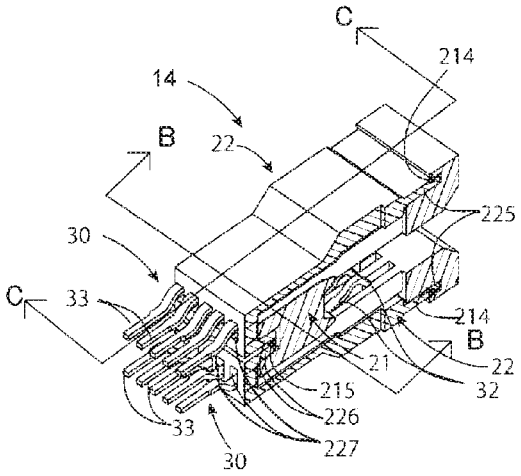
FIG. 12A is a sectional perspective view of the connector of FIG. 10 in a fully assembled state.
Figure 12B:
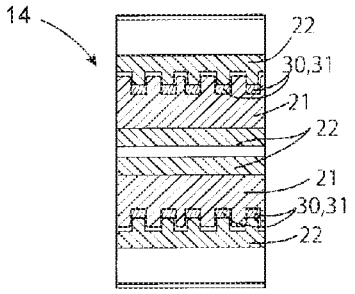
FIG. 12B is a sectional front view of the connector of FIG. 10 in the fully assembled state, taken along arrows B-B of FIG. 12A.
Figure 12C:
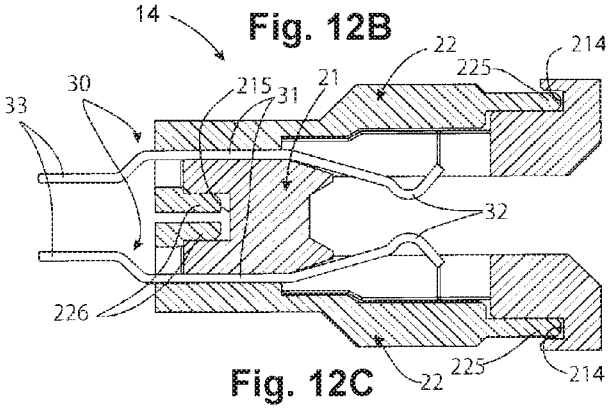
FIG. 12C is a sectional side view of the connector of FIG. 10 in the fully assembled state, taken along arrows C-C of FIG. 12A.

The connector 14 is shown fully assembled in FIGS. 12A-12C. The contacts 30 are placed on the base portion 21, and then the lid portion 22 is slid in the direction of the arrow X. The lid portion 22 is supported on the base portion 21 such that the contacts 30 are held between the lid portion 22 and the base portion 21, as shown in FIG. 12C. As shown in FIG. 12B, the housing 20 composed of the base portion 21 and the lid portion 22 comes into contact with the retained portions 31 of the contacts 30 from both above and below and from both right and left to retain the contacts 30 in the housing 20.

In all of the embodiments described above, the contacts 30 are arranged laterally and in upper and lower rows in positions where the contacts 30 overlap with each other vertically. In other embodiments, the contacts 30 may not be arranged in upper and lower rows but arranged only laterally in one row. For contacts 30 arranged only laterally, a housing that is in contact with the retained portion 31 of the contact 30 from both above and below and from both right and left can be constituted. Alternatively, for contacts 30 arranged only laterally, a housing may be formed by integral molding, such as insert molding, with the contacts 30.

What is claimed is:

1. A connector, comprising:

a housing having a base portion and a lid portion, the base portion has a plurality of contact positioning grooves and a plurality of protruding portions disposed between the contact positioning grooves, the lid portion has a plurality of opening portions receiving the protruding portions; and a plurality of contacts retained in the housing and positioned in the contact positioning grooves, each of the contacts extends in a longitudinal direction and has a retained portion, a contacting portion disposed in front of the retained portion in the longitudinal direction, and a connecting portion disposed behind the retained portion in the longitudinal direction, each of the contacting portion and the connecting portion are shifted with respect to the retained portion in a vertical direction perpendicular to the longitudinal direction, the housing is in contact with the retained portion of each of the contacts from both above and below in the vertical direction and from both right and left in a lateral direction perpendicular to the vertical direction and the longitudinal direction, the base portion and the lid portion are adapted to hold the contacts from above and below in the vertical direction.

2. The connector of claim 1, wherein the lid portion is staked to the base portion.

3. The connector of claim 1, wherein the lid portion is slidable with respect to the base portion and is supported on the base portion.

4. The connector of claim 1, wherein the contacts are arranged laterally in the housing.

5. The connector of claim 4, wherein the contacts are arranged in an upper row and a lower row and at least partially overlap with each other in the vertical direction.

6. The connector of claim 1, wherein the housing has a pair of attachment portions adapted to attach the housing to an edge of a first circuit board.

7. The connector of claim 6, wherein the housing has a mating opening receiving a second circuit board.

8. The connector of claim 7, wherein the contacts electrically connect the first circuit board and the second circuit board.

9. The connector of claim 2, wherein the base portion has a boss and the lid portion has a hole, the boss is inserted into the hole and is staked to the lid portion.

* * * * *